US008794458B2

(12) United States Patent
Horton et al.

(10) Patent No.: US 8,794,458 B2
(45) Date of Patent: Aug. 5, 2014

(54) CONTAINER SEAL

(75) Inventors: Thomas C. Horton, Newburgh, IN (US); Robin Wiggins, Newburgh, IN (US); Jeffrey Minnette, Evansville, IN (US); Randall Julian, Spurgeon, IN (US)

(73) Assignee: Mead Johnson Nutrition Company, Glenview, IL (US)

( * ) Notice: Subject to any disclaimer, the term of this patent is extended or adjusted under 35 U.S.C. 154(b) by 552 days.

(21) Appl. No.: 12/824,383

(22) Filed: Jun. 28, 2010

(65) Prior Publication Data

US 2011/0315650 A1 Dec. 29, 2011

(51) Int. Cl.
*B65D 55/02* (2006.01)

(52) U.S. Cl.
USPC ..... 215/40; 215/45; 215/245; 220/657; 220/780; 220/324; 220/234; 220/304

(58) Field of Classification Search
USPC ..... 215/DIG. 1, 317–321, 337, 40–45; 220/234, 304, 657, 780, 324, 295, 378
See application file for complete search history.

(56) References Cited

U.S. PATENT DOCUMENTS

| | | | | | |
|---|---|---|---|---|---|
| 553,543 | A | * | 1/1896 | Schiller | 215/321 |
| 2,647,652 | A | * | 8/1953 | Sanford | 215/337 |
| 3,458,079 | A | * | 7/1969 | Gasbarra | 220/787 |
| 3,567,057 | A | * | 3/1971 | Landen | 215/221 |
| 3,659,735 | A | * | 5/1972 | Landen | 215/222 |
| 3,688,942 | A | * | 9/1972 | Mitchell et al. | 220/784 |
| 3,759,415 | A | * | 9/1973 | Cloyd | 220/784 |
| 3,811,597 | A | * | 5/1974 | Frankenberg et al. | 220/284 |
| 3,817,419 | A | * | 6/1974 | Moller et al. | 220/315 |
| 3,942,679 | A | * | 3/1976 | Starr | 220/784 |
| 4,276,989 | A | * | 7/1981 | Hicks | 215/270 |
| 4,471,881 | A | | 9/1984 | Foster | |
| 5,167,344 | A | * | 12/1992 | Van Schilt | 220/657 |
| 5,402,901 | A | * | 4/1995 | Carvalheiro et al. | 215/252 |
| 5,467,344 | A | * | 11/1995 | Solomon et al. | 370/396 |
| 5,706,974 | A | | 1/1998 | Murdick et al. | |
| 5,788,064 | A | | 8/1998 | Sacherer et al. | |
| 6,761,283 | B1 | | 7/2004 | Gilliam et al. | |
| 6,772,904 | B1 | | 8/2004 | Gilliam et al. | |
| 7,464,475 | B2 | | 12/2008 | Tsao | |
| 7,469,794 | B2 | * | 12/2008 | Krueger | 215/218 |
| 7,922,028 | B2 | * | 4/2011 | Baltz | 220/657 |
| 2003/0071043 | A1 | | 4/2003 | Davis | |

(Continued)

FOREIGN PATENT DOCUMENTS

| | | |
|---|---|---|
| EP | 1967461 | 9/2008 |
| WO | 2005075314 | 8/2005 |

(Continued)

*Primary Examiner* — Tri Mai
(74) *Attorney, Agent, or Firm* — Waddey & Patterson, P.C.; James R. Cartiglia; Matthew C. Cox

(57) ABSTRACT

A container for storing matter provides a container body having a resilient flange protruding outward therefrom to form a seal between the container body and a mating closure. The resilient flange is deflected by the inner surface of the mating closure to form a first releasable seal between the closure and the container body. The resilient flange includes an aspect ratio of length divided by thickness. A second releasable seal is formed in some embodiments between the upper edge of the side wall and the closure when the mating closure is positioned on the container body.

7 Claims, 7 Drawing Sheets

(56) References Cited

U.S. PATENT DOCUMENTS

| | | | | |
|---|---|---|---|---|
| 2006/0027581 | A1* | 2/2006 | Vogel et al. | 220/254.3 |
| 2006/0027591 | A9* | 2/2006 | Sanders et al. | 221/59 |
| 2006/0156811 | A1 | 7/2006 | Borowski et al. | |
| 2008/0173657 | A1 | 7/2008 | Perry et al. | |
| 2009/0026209 | A1 | 1/2009 | Huntington et al. | |
| 2009/0032545 | A1 | 2/2009 | Zeiler et al. | |
| 2009/0050508 | A1 | 2/2009 | Van Ness | |
| 2011/0186534 | A1* | 8/2011 | Nilsson | 215/40 |

FOREIGN PATENT DOCUMENTS

| | | |
|---|---|---|
| WO | 2005082733 | 9/2005 |
| WO | 2005082734 | 9/2005 |
| WO | 2008083141 | 7/2008 |
| WO | 2008149007 | 12/2008 |
| WO | 2009081050 | 7/2009 |
| WO | 2009140627 | 11/2009 |
| WO | 2012047891 | 4/2012 |

* cited by examiner

CONTAINER SEAL

BACKGROUND OF THE DISCLOSURE

1. Technical Field

The present disclosure relates to a container for storing materials. More particularly, the present disclosure relates to a container apparatus forming a flexible seal between a container body and a lid.

2. Background Art

Containers having a structure for forming a seal with a removable lid or closure are known in the art, especially containers of the type used for storing consumable materials like food products and dietary supplements. Conventional containers of this type typically include a lid releasably secured to the container. The lid forms a seal with the container to prevent leakage of the stored material. The seal between the lid and the container also serves to prevent foreign materials from entering the container and contaminating the stored product, especially where the stored product is intended for human consumption. The stored products housed within the container may be liquid or solid. Generally, solid materials stored in such a container are in a granulated or a powdered state.

During use of a conventional handheld container of this type, the lid is opened or removed from the container by the user to access a portion of the stored product. Generally, only a fraction of the product is desired for use at a given time, while the remainder is intended for future use. Upon retrieval of a desired amount, the lid is closed against the container until the next usage to prevent leakage or contamination of the remaining product. In many applications, the container may be accessed multiple times each day.

Repeated daily access by the user can cause the seal between the lid and the container to become worn and less effective at preventing leakage or contamination. Powdered, or particulate, content is typically accessed in one of two ways. First, a user may use a scoop to retrieve a metered dose of powder from the container. Second, a user may pour the powdered material directly from the storage container into a separate container. During either of these processes for transferring powdered content from the storage container to an outside container, individual granules of powder are likely to be spilled along the rim or seal structure on the storage container. When the lid is reapplied to a conventional container, granules resting on the rim or seal structure of the container can prevent complete contact between the lid and the container, creating gaps in the seal through which additional granules may pass, allowing leakage or contamination of the stored contents.

Sealing pressure between the lid and the container is another factor affecting seal reliability. Sealing pressure can be a function of container geometry. For example, a round container having a circular seal interface generally experiences a uniform sealing pressure around the circumference of the seal. However, a container with a non-circular seal perimeter, i.e. a container with an elliptical or polygonal shape, may experience non-uniform sealing pressure around the periphery of the seal. Non-uniform sealing pressure between the lid and container can cause leakage at the regions of lower sealing pressure and can cause accelerated wear at areas of higher sealing pressure.

Conventional sealing elements for containers typically include a lid part that mates with a container part to form the seal. The seal can be located on either the lid part or the container part. The alignment of the lid part on the container part generally must be precise to ensure adequate alignment and engagement of the sealing structure between the two parts. Thus, the manufacturing tolerances for each part must fall within a narrow range. Manufacturing the lid and container parts within a relatively narrow tolerance range to ensure precision alignment of the sealing structure between the parts raises both manufacturing time and manufacturing cost.

What is needed then is a container for storing materials, having a container and lid and having a releasable seal structure positioned between the container and the lid for preventing leakage of the contents, preventing contamination of the stored content, providing adequate sealing pressure and/or allowing a wider range of manufacturing tolerances.

BRIEF SUMMARY

One aspect of the present disclosure provides a container for storing material, especially particulate material, including a container body having a side wall defining an opening in the container. A lip or flange (sometimes referred to herein as a flexible lip or resilient flange) protrudes laterally outward from the side wall. A lid engages the container body. The lid includes a lid surface spanning the opening and a lid rim projecting downward from the lid surface toward the container body. The lid rim includes an inner rim surface generally facing the lip. The inner rim surface deflects the lip, forming a first seal between the container and the lid.

Another aspect of the present disclosure provides a container for storing material. The container includes a container body including a side wall. In some embodiments the side wall includes a neck defining an opening in the container body for accessing the stored matter. A resilient flange, or lip, protrudes laterally outward from the neck. A closure releasably mates with the neck. The closure includes an annular lid rim having an inner rim surface, and in some embodiments the inner rim surface includes a tapered region oriented at an acute taper angle. The tapered region engages the resilient flange, forming a first seal between the closure and the container body.

Yet another aspect of the present disclosure provides another embodiment of a container for storing matter. The container includes a container body having a side wall defining an opening for accessing the matter. A lid is attached to the container body. The lid includes a lid surface spanning the opening. An annular lid rim protrudes from the lid surface toward the container body, and the annular lid rim defines an inner rim surface substantially facing the container body. A lip protrudes radially outward from the side wall. The lip has a length L between about 2 millimeters and about 5 millimeters and a thickness T between about 0.1 millimeters and about 0.5 millimeters. The lip defines an interference ratio with the inner rim surface between about 1.05 to about 10.0. The interference ratio is defined as the length of the lip (denoted A, in FIG. 4B) divided by the distance from the local side wall adjacent the base of the lip to the local inner rim surface at the same elevation as the lip (denoted B, in FIG. 4B).

Yet another aspect of the present disclosure provides a method of sealing a container including the steps of: (a) providing a container body including a resilient flange having a thickness T and a length L protruding laterally outward from the side wall of the container, wherein the ratio of L divided by T is greater than about two; (b) positioning a lid on the container body, the lid including an annular lid rim having a tapered inner rim surface; and (c) engaging the container body with the lid so that the inner rim surface presses against the resilient flange and angularly deflects the resilient flange, forming an annular seal between the flange and the inner rim surface.

Numerous objects, features and advantages of the present disclosure will be readily apparent to those skilled in the art upon a reading of the following disclosure when taken in conjunction with the accompanying drawings.

DETAILED DESCRIPTION

Figure 1:
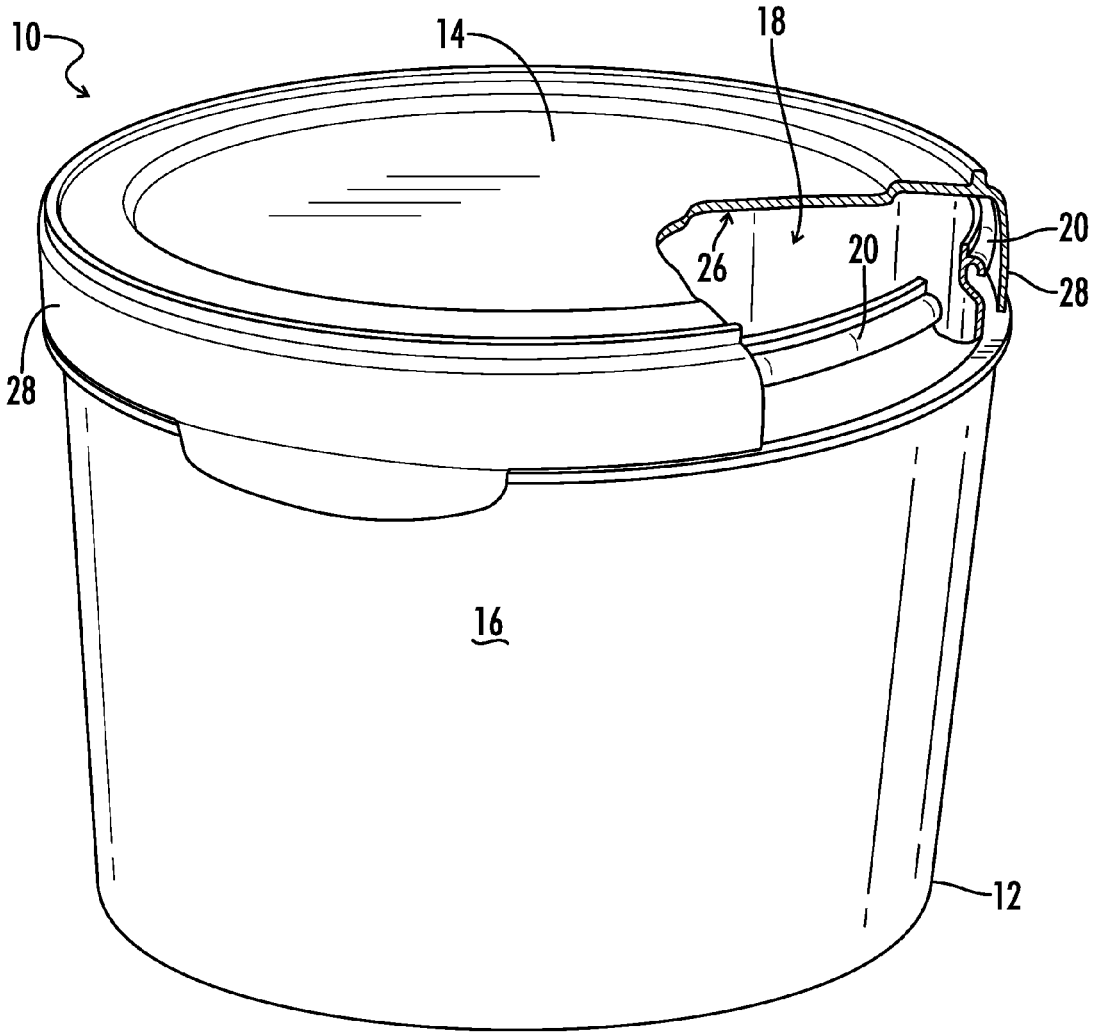
FIG. 1 illustrates a partially broken away perspective view of one embodiment of a container apparatus.

Referring to the drawings, FIG. 1 illustrates a partially broken away view of one embodiment of a container apparatus 10. On the drawings, not all reference numbers are included in each drawing, for the sake of clarity. In addition, positional terms such as "upper," "lower," "side," "top," "bottom," etc. refer to the container when in the orientation shown in the drawing. The skilled artisan will recognize that containers can assume different orientations when in use.

Container apparatus 10 includes a container body 12 and a closure, or lid 14. Container body 12 includes a container side wall 16. In one embodiment, side wall 16 forms an oval-shaped cross-sectional profile and defines an opening 18 in the container body 12. Lid 14 is attached to container 12 so that lid 14 can be rotated or removed to access the opening 18. In one embodiment, the lid 14 is pivotally attached to the container body 12 by a hinge member (not shown). In another embodiment, the lid 14 can be removed from the container body 12. The opening 18 is generally revealed when the lid 14 is either removed completely from the container 12 or pivoted away from the container body 12 about the hinge member. Stored material is housed in the container body 12 and is accessed by the user through the opening 18 after the lid 14 has been removed or pivoted away from the container body 12. While the embodiment illustrated in FIG. 1 includes an oval cross-sectional profile, it will be appreciated by those of skill in the art that the principles of the present disclosure may be applied to containers having various other cross-sectional profiles, including but not limited to circular, rectangular, polygonal, and other linear or curvilinear shapes.

Figure 2A:
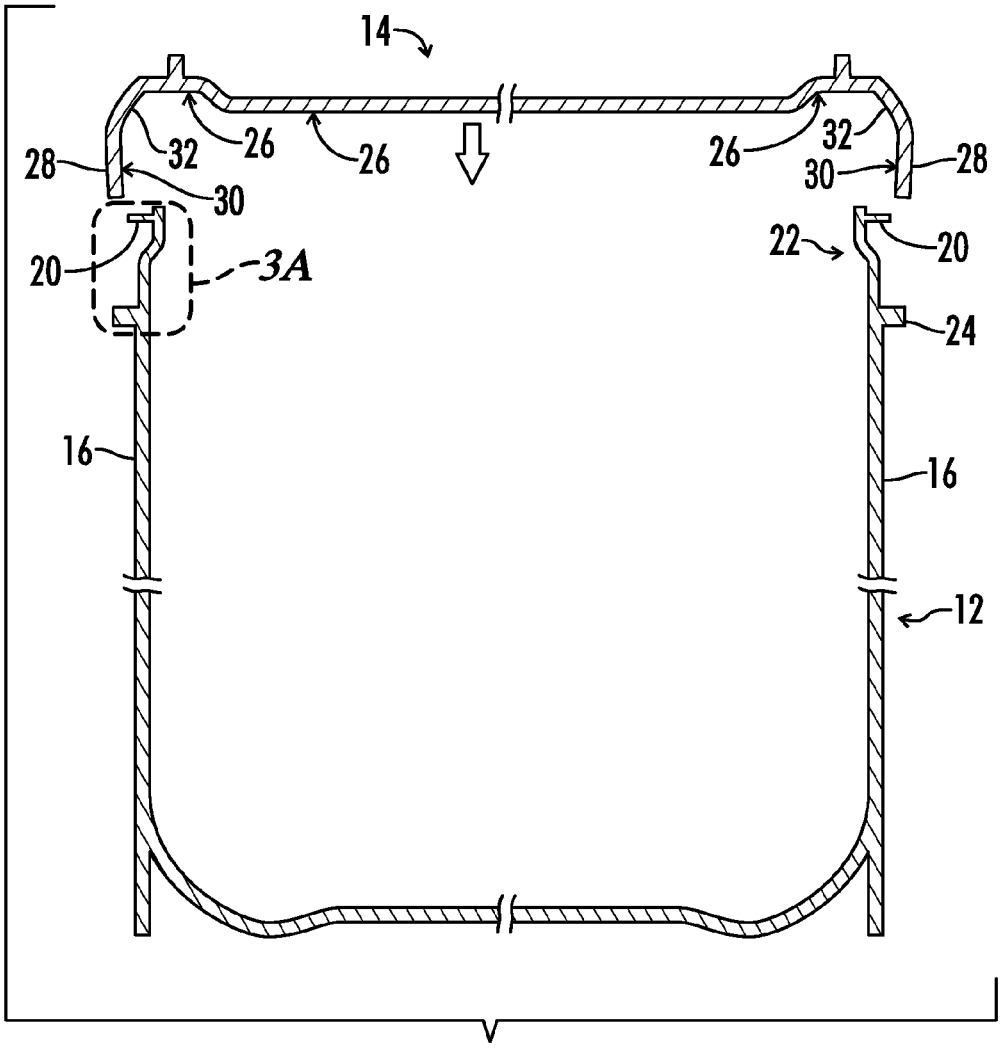
FIG. 2A illustrates a partial cross-sectional exploded view of an embodiment of a container apparatus.

Lid 14 includes a lid surface 26 spanning the opening 18, seen in FIG. 2A. A lid rim 28, projects from the lid surface 26 generally toward the container body 12. In one embodiment, the lid rim, or annular lid rim 28 includes a continuous ring shape. The lid rim 28 includes an inner rim surface 30 generally facing the interior of the container body 12 when lid 14 is positioned on container body 12.

Figure 4A:
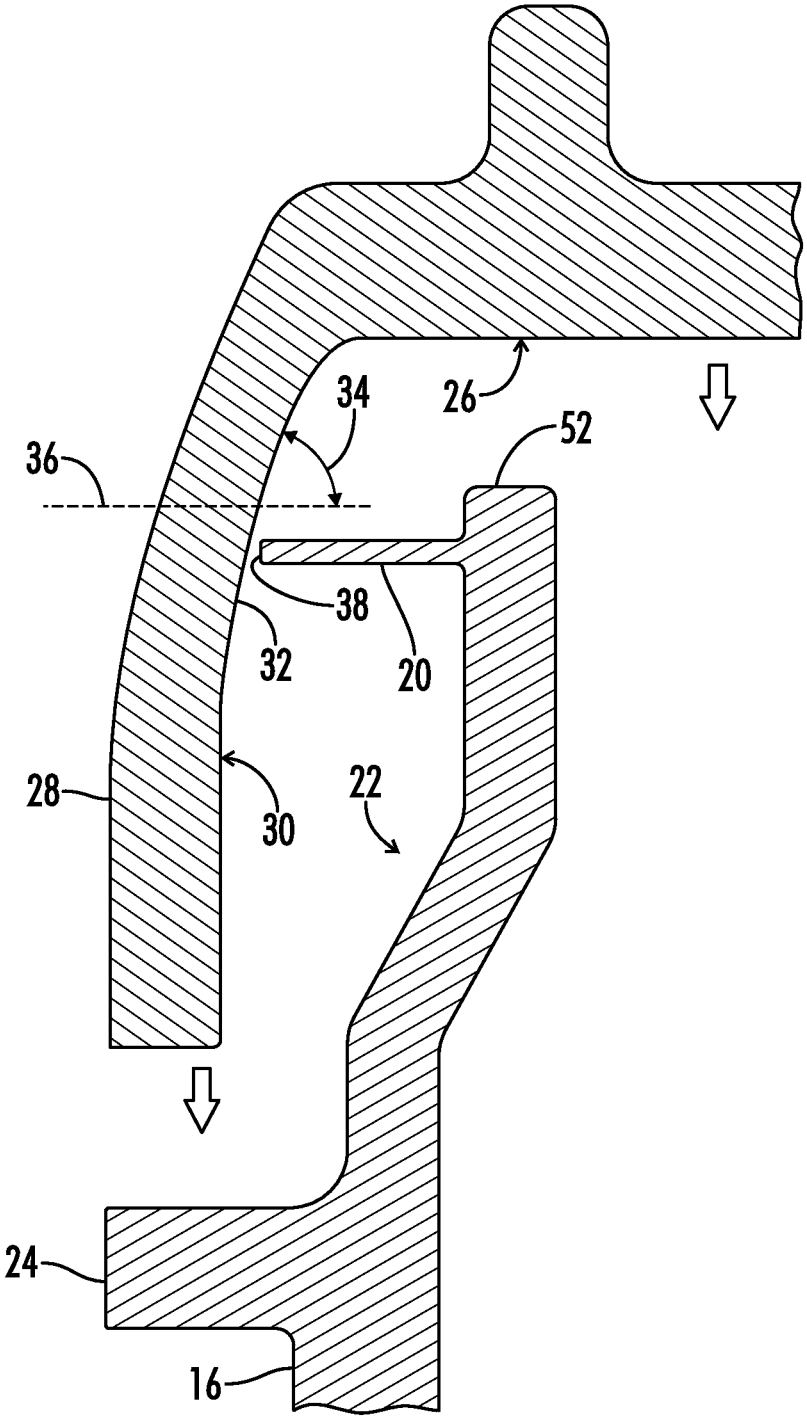
FIG. 4A illustrates a detail cross-sectional exploded view of an embodiment of a container apparatus.

Referring further to FIG. 2A, the inner rim surface 30 in one embodiment includes a tapered region 32 oriented at an acute taper angle 34 relative to a horizontal reference axis 36, also seen in FIG. 4A. In one embodiment, horizontal reference axis 36 is oriented substantially parallel to the lid surface 26 of lid 14. The taper angle 34 in some embodiments can range between about thirty degrees and about eighty-nine degrees. It will be appreciated that the taper angle 34 can vary around the perimeter of the inner rim surface 30 and may be locally obtuse or may include a linear or curvilinear shape. In one embodiment, lid 14 is formed by an injection molding process where a heated plastic material is introduced into an injection mold having the shape of the lid 14. Upon cooling and solidification of the plastic material, the lid 14 is then removed from the injection mold. The injection mold can include a draft angle for facilitating removal of the molded part from the mold cavity. Accordingly, in one embodiment, the taper angle 34 is substantially equal to the draft angle used in the injection mold to allow removal of the lid 14. In yet another embodiment, the taper angle 34 is substantially perpendicular to the horizontal reference axis 36. In still another embodiment, the taper angle 34 is between about sixty and about ninety degrees. In a further embodiment, the taper angle 34 is between about 72 degrees and about 78 degrees. The tapered region 32 is generally configured to releasably engage a lip, or resilient flange 20 extending from container body 12.

Figure 3A:
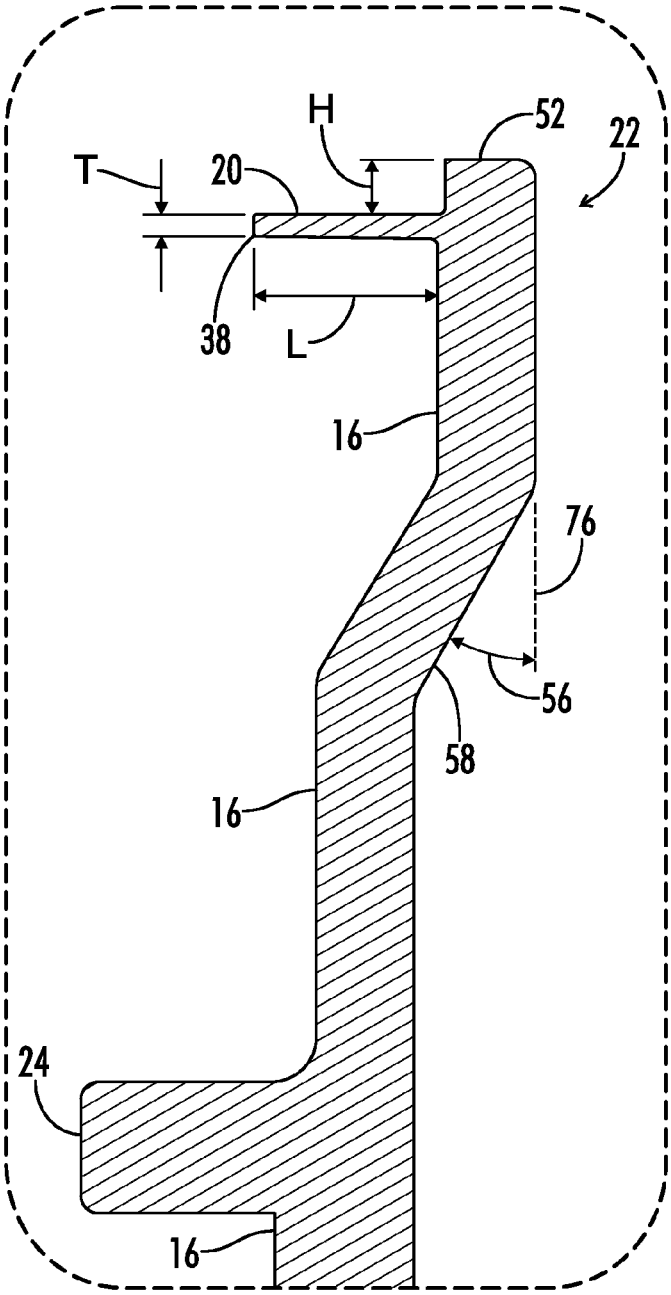
FIG. 3A illustrates a detail cross-sectional view of an embodiment of a container apparatus.
Figure 3B:
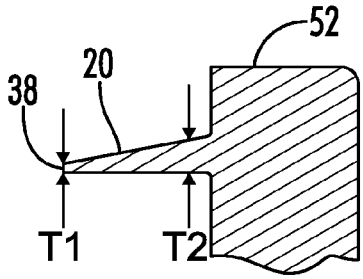
FIG. 3B illustrates a detail cross-sectional view of an embodiment of a container apparatus.

Referring now to the embodiment shown in FIG. 3A, a detail view of the upper region, or neck 22, of side wall 16 from FIG. 2A is generally shown. Lip 20 protrudes laterally outward from side wall 16. In one embodiment, side wall 16 forms an uninterrupted outer perimeter of container body 12, and lip 20 extends continuously from sidewall 16 around the uninterrupted outer perimeter. Lip 20 protrudes a length L from the side wall 16 and includes a thickness T. Length L is measured from the local side wall 16 near the base of the lip 20 to the distal tip 38 of the lip 20. The lip has a length L between about 2 millimeters and about 5 millimeters and a thickness T between about 0.1 millimeters and about 0.5 millimeters in some embodiments. The thickness T and length L may vary along the lip 20 due to manufacturing tolerances within an allowable range. In yet another embodiment, the thickness T and length L can be intentionally varied along the lip 20 to influence sealing performance. In one embodiment, the thickness T of lip 20 is substantially uniform along length L, as seen in FIG. 3A. Referring to FIG. 3B, in yet another embodiment, thickness T varies along length L of lip 20. In this embodiment, a non-uniform thickness T provides a unique deflection profile. For example, in one embodiment a lip 20 includes a distal tip, or distal end 38 of lip 20 having a distal thickness T1 and a proximal end having a proximal thickness T2 greater than T1. The proximal end is located nearer the side wall than the distal end 38. In some embodiments, lip 20 defines a variance ratio equal to distal thickness T1 divided by proximal thickness T2. The ratio of the thickness T1 at distal end 38 to the thickness T2 at proximal end of lip 20 can be termed a variance ratio. In certain embodiments, the variance ratio equals one, denoting a uniform thickness lip 20. In yet other embodiments, the variance ratio is between about 0.1 and about 0.9, forming a lip 20 having a distal end that is more flexible than the proximal end. In further embodiments, the variance ratio is between about 1.0 and about 3.0, forming a lip 20 having a proximal end that is more flexible than the distal end.

Figure 2B:
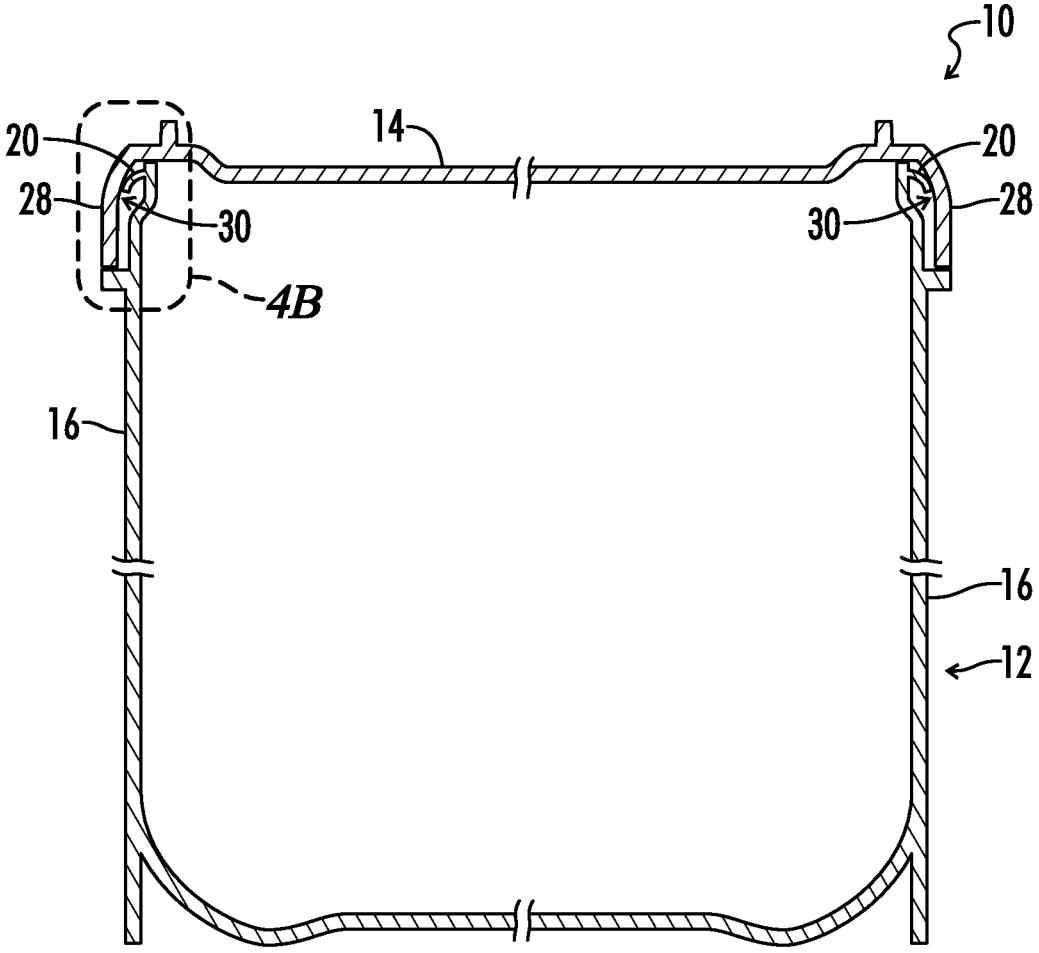
FIG. 2B illustrates a partial cross-sectional view of the embodiment of a container apparatus of FIG. 2A.
Figure 4B:
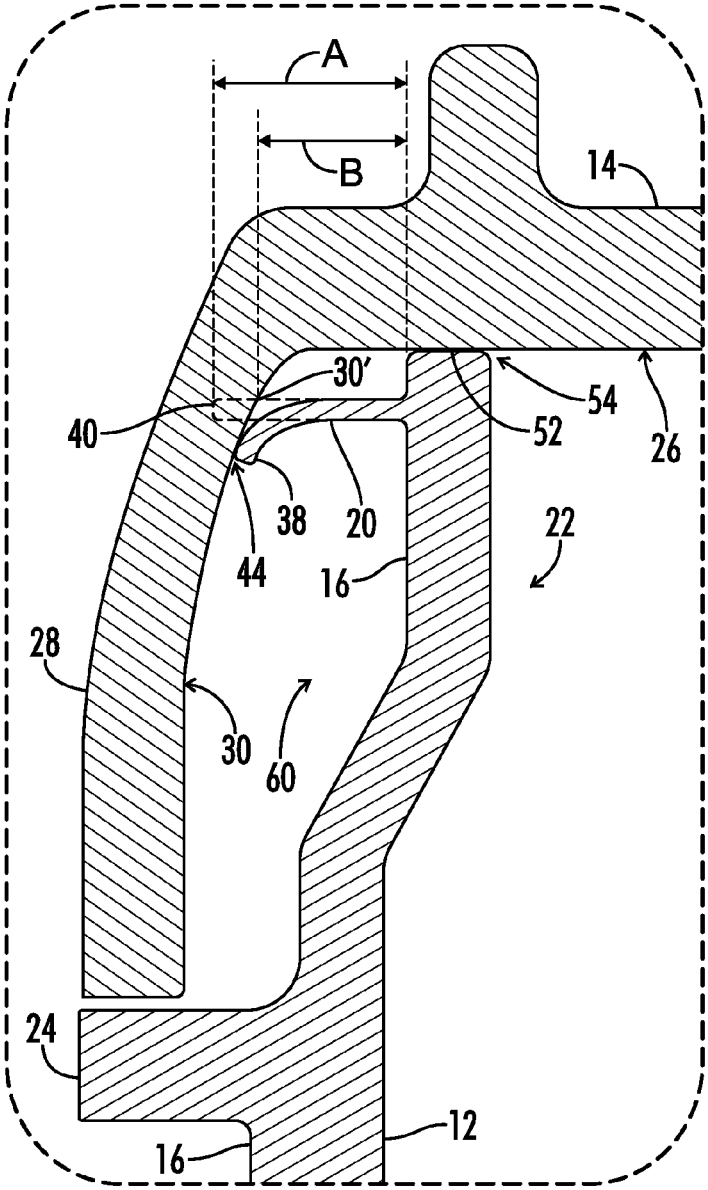
FIG. 4B illustrates a detail cross-sectional view of an embodiment of a container apparatus.

In the embodiments shown in FIGS. 2A and 4A, lid 14 is secured to container body 12 by pressing lid 14 onto the container body 12 from above, forming a fully-seated configuration shown in the partial cross-sectional views of FIGS. 2B and 4B. Initially, as lid 14 is pushed down against the container body 12, inner rim surface 30 engages the distal tip 38 of lip 20. Lip 20 forms an interference-fit with the inner rim surface 30 of lid rim 28, causing the lip 20 to be deflected by the inner rim surface 30, as seen in FIGS. 2B and 4B, forming a first seal 44 between the lid 14 and the container body 12. Referring further to FIG. 4B, an interference ratio is defined as distance A from the local side wall 16 to the initial, or non-flexed, distal tip position 40 of lip 20, divided by distance B from the local side wall 16 to the local inner rim surface 30' at the same elevation as the base, or proximal end, of lip 20. The interference ratio, A divided by B, or A/B, is greater than one. Thus, as lid 14 is pushed onto container body 12 toward the fully-seated position seen in FIG. 4B, lid 14 engages and imparts a bending moment on lip 20, causing the lip 20 to bend, or deflect, away from the lid surface 26. In one embodiment, the inner rim surface 30 defines an uninterrupted inner rim perimeter continuously engaging lip 20. The interference ratio (distance A divided by distance B, seen in FIG. 4B) in some embodiments is between about 1.05 and about 10.0; in other embodiments the interference ratio is between about 1.1 and about 3.0. In certain embodiments, distance A is between about 1.1 millimeters and about 4.0 millimeters and distance B is between about 1.0 millimeters and about 3.0 millimeters, wherein distance A is greater than distance B. In yet another embodiment, distance A is between about 1.8 and about 2.5 millimeters and distance B is between about 1.7 and about 2.4 millimeters, again, provided distance A is greater than distance B. It is also understood that, in some embodiments, interference ratio A divided by B can be greater than ten.

Figure 4C:
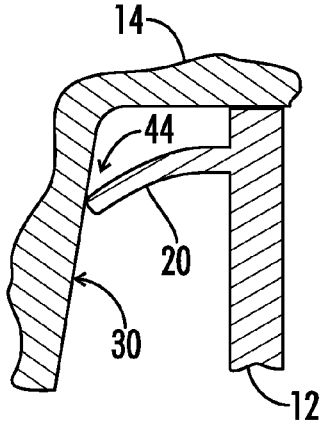
FIG. 4C illustrates a detail cross-sectional view of an embodiment of a lip.
Figure 4D:
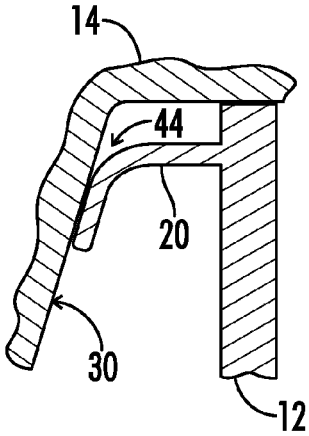
FIG. 4D illustrates a detail cross-sectional view of an embodiment of a lip.

Lip 20, when deflected by inner rim surface 30, forms a deflection profile, as seen in some embodiments shown in FIGS. 4B, 4C and 4D. The deflection profile of the lip 20 can influence the performance of the seal between lip 20 and inner rim surface 30. The deflection profile of the deflected lip 20 is influenced by any or all of several factors, including, for example, acute taper angle 34 of the inner rim surface 30, the interference ratio (A divided by B), length L of lip 20, thickness T of lip 20, and the modulus of elasticity of the material forming lip 20. These parameters can be used individually or in combination to produce a seal having a desired deflection profile and desired performance characteristics. It is understood that the deflection profile can vary along the circumference of the seal between lid 14 and container body 12. In one embodiment, seen in FIG. 4C, the deflection profile establishes line contact between a point on lip 20 and inner rim surface 30. In yet another embodiment, seen in FIG. 4D, the deflection profile establishes surface-to-surface contact between lip 20 and inner rim surface 30. In other embodiments in accordance with the present disclosure, both line contact and surface-to-surface contact exist between lip 20 and inner rim surface 30 at different positions along the circumference of the annular seal 44.

Referring again to FIG. 3A, lip 20 includes dimensional parameters that influence the deflection profile of the deflected lip, as seen in one exemplary embodiment in FIG. 4B. Specifically, the aspect ratio of lip 20 equals length L divided by thickness T, or L/T (when the variance ratio is other than 1.0, the thickness employed in determining aspect ratio is the average thickness of lip 20), seen in FIG. 3A. The aspect ratio, inter alia, influences the flexibility of lip 20 when a bending moment is applied to the distal tip 38 by the inner rim surface 30 of lid rim 28. A lower aspect ratio generally causes lip 20 to be more resistant to flex, while a higher aspect ratio generally causes lip 20 to be more flexible. The aspect ratio in some embodiments of the present disclosure is greater than about 2, and is generally no greater than about 30. The aspect ratio in yet another embodiment is between about 6 and about 12. In some other embodiments, the aspect ratio may be between about 12 and about 30. Although lip 20 can be used without any technical upper limit to aspect ratio, a practical upper limit is reached at about fifty.

Other dimensional parameters also influence the flexibility and performance of lip 20. For example, the thickness T of the lip 20, in combination with the aspect and/or interference ratios, influences flexibility and seal performance. A lip 20 having an aspect ratio greater than about 6, but also having a relatively large thickness, i.e. greater than about 3 millimeters, may not exhibit the desired ability to resiliently flex upon application and removal of the lid 14 to the container 12. The lip 20 of the present disclosure generally includes a thickness T having dimensional parameters chosen to allow the lip 20 to flex when engaged by the inner rim surface 30 and to resiliently return to at least a partially non-flexed position when lid 14 is removed or rotated away from container 12. Both the thickness T and the aspect ratio (length L divided by thickness T) are chosen to achieve a desired deflection profile.

Referring again to FIG. 4B, the contact interface between the lip 20 and the inner rim surface 30 forms the first seal 44. The first seal 44 is releasable, allowing lid 14 to be disengaged from the container body 12 and lip 20 to be separated from inner rim surface 30. The lip 20, or resilient flange, includes an elastically deformable material. In one embodiment, both the lip 20 and the container body 12 are integrally formed from the same elastically deformable material, i.e. an injection molded thermoplastic polymer such as but not limited to polypropylene. As such, when lid 14 is removed from container body 12, the lip 20 returns to a position at or near the initial position, seen for example in FIG. 4A. In one embodiment, the dimensional parameters, including interference ratio, aspect ratio and thickness, are chosen so that lip 20 at the maximum point of deflection experiences only elastic deformation stress, allowing lip 20 to return completely to the original position, as seen in FIG. 4A, upon removal of the lid 14 from the container 12. In yet another embodiment, the local deformation stress experienced by lip 20 in some regions when the lid 14 is applied to container body 12 exceeds the elastic deformation limit, and lip 20 undergoes local plastic deformation. Local plastic deformation causes the lip 20 to resiliently return only partially to its original position upon removal of the lid 14 from the container body 12. For example, the lip 20 can include a first region that undergoes elastic deformation only and a second region that undergoes plastic deformation. In one embodiment, lip 20 forms an annular ring shape having an elliptical profile around the perimeter of the container body 12. The container thus includes a first region having a first radius of curvature and a second region having a second radius of curvature smaller than the first radius of curvature. In this embodiment in accordance with the present disclosure, lip 20 can experience only elastic deformation along the regions having a higher radius of curvature and can experience plastic deformation along the regions having a lower radius of curvature. In one embodiment, the container body 12 contains a thermosetting or thermoplastic material and has an elastic modulus between about 0.1 GPa and about 5.0 GPa. In yet another embodiment, the container body 12 includes polypropylene and has an elastic modulus between about 1.3 and about 1.8 GPa.

Referring to FIG. 4B, it is apparent that, in one embodiment, the resiliency of lip 20 allows annular lid rim 28 to move relative to neck 22 without first seal 44 becoming separated. This aspect of one embodiment of the present disclosure allows manufacture within a broader range of manufacturing tolerances, as the fit between lip 20 and inner rim surface 30 does not need to be exact to ensure contact between lip 20 and inner rim surface 30. Rather, the interference ratio (distance A divided by distance B), along with other design parameters, is chosen so that contact between lip 20 and inner rim surface 30 will provide a first seal 44 across a wide range of manufacturing tolerances. This aspect of one embodiment of the present disclosure further provides improved sealing performance, allowing lid 14 to shift relative to container body 12 without disrupting first seal 44.

Figure 3C:
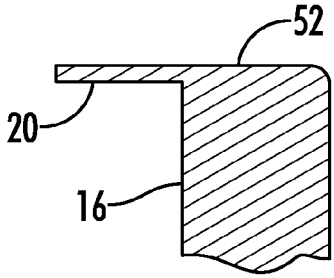
FIG. 3C illustrates a detail cross-sectional view of an embodiment of a container apparatus.

Referring again to FIG. 4B, another aspect of the present disclosure provides a double-seal configuration, wherein a first seal 44 is formed between lip 20 and inner rim surface 30, and a second seal 54 is formed between side wall 16 and lid 14. More specifically, in one embodiment, the side wall 16 includes an upper region, or neck 22, defining an opening 18 for accessing the material stored in the container body 12. The neck 22 is adapted for engaging lid 14. Neck 22 includes an upper edge 52, seen in FIGS. 4A and 4B. In some embodiments, lip 20 is vertically offset from upper edge 52 by an offset height H, seen in FIG. 3A. In one embodiment, offset height H can range up to the maximum distance between upper edge 52 and lateral rim 24. In some embodiments, as seen in FIG. 3C, offset height H is zero, and lip 20 is substantially coextensive with upper edge 52. In another embodiment, H is greater than zero. In other embodiments, H is greater than 0.01 millimeters. In yet another embodiment, H is greater than 0.1 millimeters. In another embodiment, offset height H is up to about 2.0 millimeters. In yet another embodiment, offset height H is at least about 0.4 millimeters. When lid 14 is fully-seated on container body 12, as seen in FIG. 4B, lid surface 26, or closure surface, engages upper edge 52, forming second seal 54. In one embodiment, upper edge 52 has an annular shape that continuously engages lid surface 26 around the entire circumference of annular upper edge 52. Second seal 54 is formed by the contact interface between upper edge 52 and lid surface 26. As such, second seal 54 is releasable by removing lid 14 from container body 12. In one embodiment, first seal 44 can remain intact even when the second seal 54 becomes separated by a gap distance. For example, if the container 10 were subjected to rough handling such that second seal 54 became disengaged, lip 20 could maintain contact with inner rim surface 30.

Figure 5A:
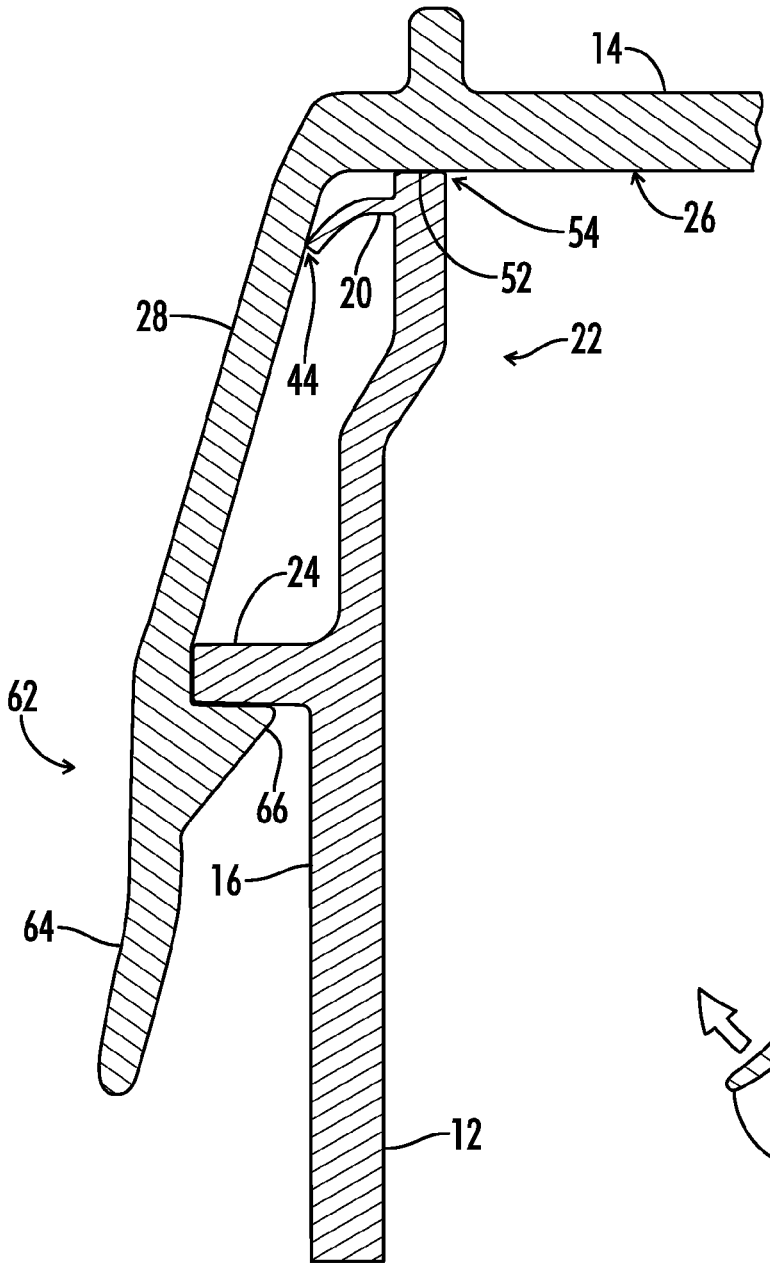
FIG. 5A illustrates a cross-sectional view of an embodiment of a container apparatus.
Figure 5B:
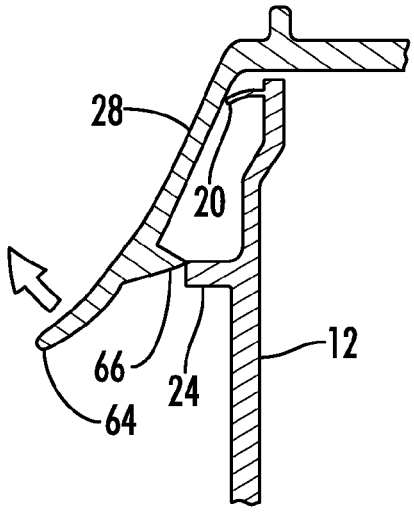
FIG. 5B illustrates a cross-sectional view of an embodiment of a container apparatus.

Referring now to FIG. 5A, a latch member 62 is generally shown. When lid 14 is fully-seated on container body 12, lip 20 is deflected, as seen in FIG. 5A. Because lip 20 is formed of a resilient material, an upward force is imparted on lid 14 when the lip 20 is in a downwardly deflected position. In one embodiment, the upward force causes lid 14 to be pushed away from container body 12. Thus, a securement means is necessary to maintain lid 14 in a closed and fully-seated position and to prevent lid 14 from being pushed off of container body 12. In one embodiment, seen in FIG. 5A, lid 14 is secured in a closed position by a latch member 62 positioned on lid rim 28. Latch member 62 includes a latch hook 66 protruding toward the container body 12. The latch hook 66 engages lateral rib 24 protruding from side wall 16 when lid 12 is in the fully-seated and closed position. In one embodiment, the lateral rib 24 includes an extended region for engaging the latch hook 66. The latch member 62 in one embodiment includes a latch tab 64 that can be selectively lifted by the user for releasing the latch member 62, as seen in FIG. 5B. Generally, the user can lift latch tab 64 to allow latch hook 66 to pass over lateral rib 24 for opening the container. Latch member 62 generally includes an elastic material and resiliently flexes when lifted by the user. It will be understood by those of skill in the art that the latch member 62 described herein is only one of several ways to secure lid 14 against container body 12 in a closed position for maintaining a seal between lid 14 and container body 12.

Also seen in FIG. 3A, neck 22 includes an offset region 58 oriented at a neck offset angle 56 relative to offset reference axis 76. In some embodiments, offset reference axis 76 is substantially parallel to side wall 16 adjacent to the offset region 58, as seen in FIG. 3A. In some embodiments, neck offset angle 56 is between about fifteen and about sixty degrees. Offset region 58 defines a deflection gap 60, seen in FIG. 4B, for accommodating lip 20 in a deflected position.

Another aspect of the present disclosure provides a method of sealing a container. The method includes the steps of: (a) providing a container body including a resilient flange having a thickness T and a length L protruding laterally outward from the side wall of the container, wherein the ratio of L divided by T is greater than about two; (b) positioning a lid on the container body, the lid including an annular lid rim having a tapered inner rim surface; and (c) engaging the container body with the lid so that the inner rim surface presses against the resilient flange and angularly deflects the resilient flange toward the container, forming an annular seal between the flange and the inner rim surface. In another embodiment, an additional step includes latching the lid to the container body to maintain sealing pressure between the lid and the flange.

Thus, although there have been described particular embodiments of the present invention of a new and useful Improved Container Seal, it is not intended that such references be construed as limitations upon the scope of this invention except as set forth in the following claims.

What is claimed is:

1. A container for storing material, the container comprising:

a container body having a side wall defining an opening in the container, the side wall including an upper edge;

a resilient integrally formed lip protruding laterally outward from the side wall at a position vertically offset below the upper edge of the side wall;

a lateral rib protruding laterally outward from the side wall between the container body and the lip;

a lid engaging the container body, the lid including a lid surface spanning the opening and a lid rim projecting from the lid surface, the lid rim including an inner rim surface generally facing the lip, the inner rim surface including a tapered region oriented at an acute taper angle, the tapered region of the inner rim surface deflecting the lip and forming a first seal between the container body and the lid when the lid is closed against the container; and a latch member protruding from the lid rim toward the container body, the latch member including a latch hook extending from the latch member, wherein the latch hook engages the lateral rib for securing the closure to the container, and wherein the upper edge engages the lid surface and forms a second seal between the container body and the lid when the lid is closed against the container.

2. The container of claim 1, wherein the lip has a thickness T and protrudes a length L from the side wall, the lip defining an aspect ratio equal to length L divided by thickness T.

3. The container of claim 2, wherein the aspect ratio is between about 6 and about 30.

4. The container of claim 1, wherein:

the side wall includes an uninterrupted outer perimeter; and the lip extends continuously around the uninterrupted outer perimeter.

5. The container of claim 4, wherein the inner rim surface defines an uninterrupted inner lid perimeter continuously engaging the lip.

6. The container of claim 1, wherein:

the lip includes a proximal end integrally formed on the container body and a distal end projecting away from the container body;

the distal end has a first thickness T1; and the proximal end has a second thickness T2 which is greater than T1.

7. A method of sealing a container, comprising the steps of:

(a) providing a container body including an upper edge and an integrally formed resilient flange having a thickness T and a length L protruding laterally outward from the side wall of the container, the flange protruding from the side wall at a vertical offset distance below the upper edge, wherein the ratio of L divided by T is greater than about two, wherein the container further comprises a lateral rib protruding laterally outward from the side wall;

(b) positioning a lid on the container body, the lid including an annular lid rim having a tapered inner rim surface oriented at an acute taper angle, the lid having an interior closure surface facing the interior of the container body, the lid including a latch member protruding from the lid rim toward the container body and a latch hook extending from the latch member;

(c) engaging the container body with the lid so that the inner rim surface presses against the resilient flange and angularly deflects the resilient flange toward the container, forming an annular first seal between the flange and the inner rim surface and so that the latch hook engages the lateral rib to latch the lid to the container body to maintain sealing pressure between the lid and the flange; and (d) engaging the container body with the lid so that the upper edge presses against the interior closure surface, forming an annular second seal between the upper edge and the interior closure surface.

* * * * *